United States Patent [19]

Gieske et al.

[11] Patent Number: 4,891,897

[45] Date of Patent: Jan. 9, 1990

[54] DISPLAY PANEL

[76] Inventors: Detlef J. Gieske; David B. Kawchak, both of 13800 Ella Blvd., F207, Houston, Tex. 77014

[21] Appl. No.: 151,228

[22] Filed: Feb. 1, 1988

Related U.S. Application Data

[63] Continuation-in-part of Ser. No. 808,421, Dec. 12, 1985, Pat. No. 4,722,147.

[51] Int. Cl.[4] ..... G09F 7/02; A47F 5/08

[52] U.S. Cl. ..... 40/618; 211/87; 211/94; 211/189; 248/222.2

[58] Field of Search ..... 248/220.3, 222.2, 223.4; 211/189, 87, 94; 40/618, 620, 624, 622; 52/38

[56] References Cited

U.S. PATENT DOCUMENTS

| | | | |
|---|---|---|---|
| 454,769 | 6/1891 | Roberts | 40/622 |
| 3,327,419 | 6/1967 | Stanos | 40/618 |
| 3,636,669 | 1/1972 | Attkisson | 40/605 |
| 4,591,058 | 5/1986 | Amstutz et al. | 248/222.2 |
| 4,607,753 | 8/1986 | Radek | 248/222.2 |
| 4,694,965 | 9/1987 | Parnell | 248/222.2 |

FOREIGN PATENT DOCUMENTS

| | | | |
|---|---|---|---|
| 668348 | 7/1929 | France | 40/618 |

*Primary Examiner*—Richard J. Apley
*Assistant Examiner*—J. Welsh
*Attorney, Agent, or Firm*—Harrison & Egbert

[57] ABSTRACT

A display panel comprising a substantially planar structural layer of rigid material, a plurality of slats fastened to the structural layer, and a fastener for attaching the structural layer to a wall. The slats have a first surface that fastens flush against the structural layer. The slats also have a substantially planar second surface opposite the first surface. A horizontal slot is defined by the area between adjacent slats. A receiving slot is formed within each of the slats and extends upwardly transverse to the horizontal slot has an angled portion extending outwardly from the horizontal slot, and communicates with the horizontal slot. The fastener is a cleat which is fixedly attached to the side of the structural layer opposite the slats. The cleat has an angle cut along its lower edge.

15 Claims, 7 Drawing Sheets

DISPLAY PANEL

RELATED APPLICATIONS

The present application is a continuation-in-part of U.S. application Ser. No. 808,421, filed Dec. 12, 1985, and entitled "Display Panel". This application will issue as U.S. Pat. No. 4,722,147 on Feb. 2, 1988.

TECHNICAL FIELD

The present invention relates to panels for the display of objects, more particularly, the present invention relates to portable panels that can be used to display merchandise signs, or other objects.

BACKGROUND ART

In the setting of department stores, the display of merchandise often becomes a critical concern. Some merchandise may sell more rapidly in one location of a store than in another location. The introduction of new products for sale also creates problems as to the proper manner for displaying these products. In many instances, the inability to properly display merchandise can determine the success or failure of the product being offered for sale. Ultimately, this can reflect on the profitability of the store offering this merchandise for sale.

In the past, merchandise has been offered for sale from racks, fixtures, hangars, shelves, peg boards, and the like. Fixtures are often permanently embedded into the store. Racks are often unmovable or, at least, difficult to rearrange. Throughout virtually all department stores, shelves remain as shelves throughout the life of the store, racks remain as racks throughout the life of the store, and very little flexibility, interchangeability, or adaptability occurs.

A recent innovation in the field of fixturing for stores has been the use of slatwalls. Slatwalls accommodate a wide variety of slatwall hardware. This means that various types of hangers can be interchangeably introduced to the slatwall fixture. Unfortunately, slatwall fixtures are generally permanently affixed to the walls of the store, or generally unsuitable for shelving, and present a relatively unattractive visual appearance within the stores.

It is an object of the present invention to provide a display panel that is suitable for the receipt of shelving and slatwall hardware and accessories.

It is another object of the present invention to provide a display panel that is easily movable from one wall to another within a store.

It is another object of the present invention to provide a display panel that can receive signs.

It is still a further object of the present invention to provide a display panel that may be uniformly manufactured and relatively easily installed.

It is still a further object of the present invention to provide a display panel that is aesthetically attractive.

These and other objects and advantages of the present invention will become apparent from a reading of the attached specification and appended claims.

SUMMARY OF THE INVENTION

The present invention is a display panel comprising a substantially planar structural layer of rigid material; a plurality of slats fastened to the structural layer; and fasteners for removably attaching the display panels to an adjacent surface. The slats of the present invention have a first surface that fastens flush against the structural layer. The slats have a substantially planar surface opposite the first surface. The area between each of the slats defines a horizontal slot. A slot having an angled side extends upwardly transverse to the horizontal slot within the slats. Fasteners are attached to the side of the structural layer opposite the slats.

The slats of the present invention comprise members of molded plastic fastened to the structural layer. These members have a slot formed about the edge of the member which extends longitudinally along the member. A face piece is fastened to the side of the member opposite the structural layer. A flexible material, such as cloth, vinyl, VELCRO, laminants, or other materials are fixedly fastened to the exterior surface of the slats. hook-and-loop material may be used for receiving objects having VELCRO tape, or VELCRO-like tape, attached thereto. This flexible material is received by the slot.

A strip of hook-and-loop material is fastened to the structural layer at the area of the horizontal slot. This VELCRO-like material is for fixing the horizontal movement of an object, such as a shelf, placed into the horizontal slot. The fastener of the present invention is a cleat that is fixedly attached to the side of the structural layer opposite the slats. This cleat has an angle cut along its lower edge. This angle cut serves to engage a complementary angle cut in a support structure. This angle cut extends along the entire length of the cleat. The complementary angle-cut cleat is of the type that may be fixedly fastened to an interior wall or support structure, of an enclosure. Such an enclosure may be a department store. The cleat on the display panel slidably engages and is gravity-maintained within the complementary cleat.

BEST MODE FOR CARRYING OUT THE INVENTION

Figure 1:
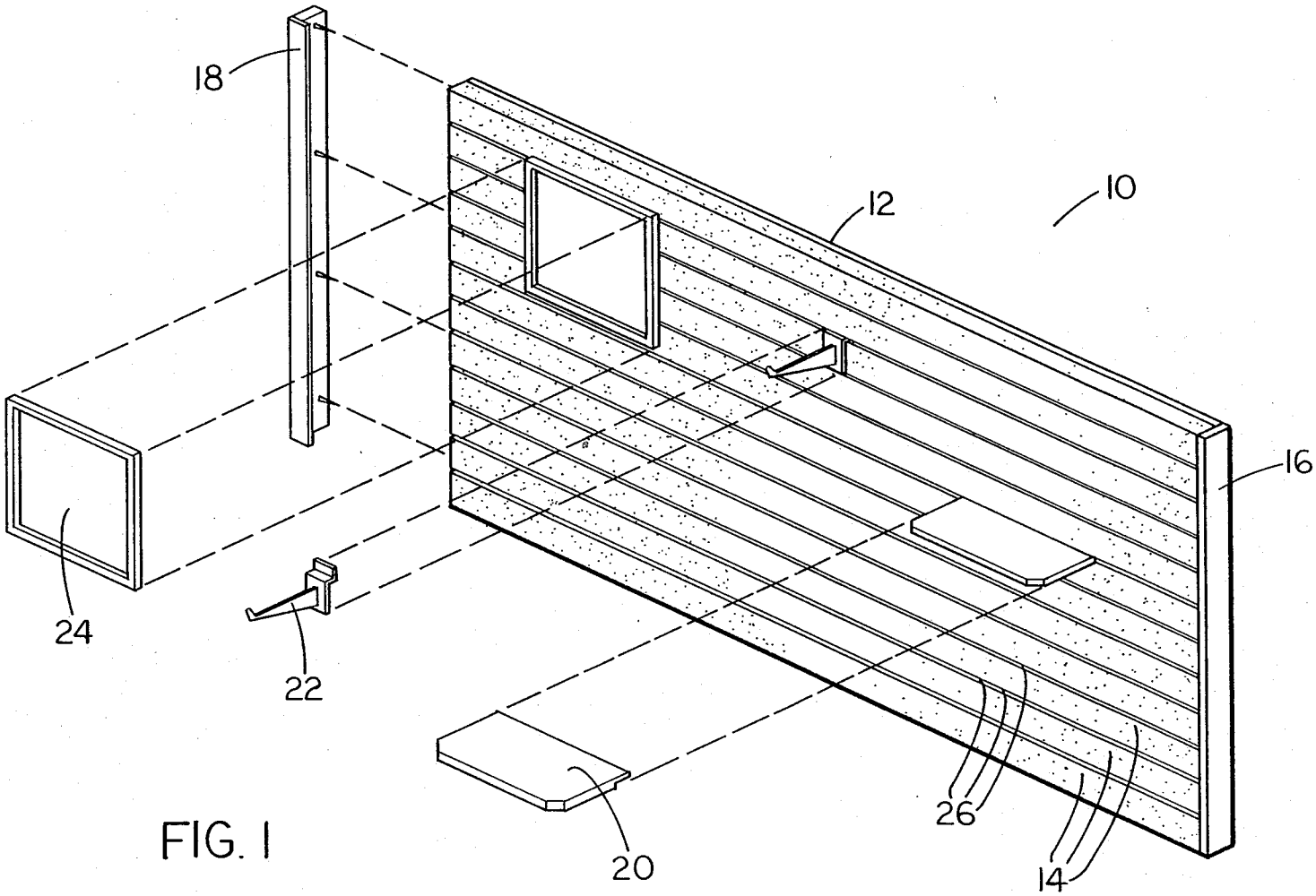
FIG. 1 is a perspective view of the display panel of the present invention.

Referring to FIG. 1, there is shown at 10 the display panel in accordance with the present invention. Display panel 10 has planar structural layer 12, slats 14, end caps 16 and 18, shelf 20, slatwall hanger 22, and sign 24. FIG. 1 shows the accessories 20, 22, and 24 fastened to display panel 10.

As shown in FIG. 1, slats 14 are fastened to structural layer 12. Each of the slats 14 has a length generally equal to the length of the structural layer. Each of the slats 14 also has a width generally equal to a fraction of the width of the structural layer. As shown in FIG. 1, there are twelve slats 14. The area between the slats 14 defines horizontal slots 26. These horizontal slots 26 extend for the length of the structural layer. In FIG. 1, shelf 20 slidably engages a horizontal slot 26. Slatwall hanger 22 is also received by a slot 26. However, it should be noted, that horizontal slot 26 does not totally receive slatwall hanger 22. A slot having an angled wall (to be described hereinafter) serves to properly receive the slatwall hanger 22. Sign 24 is removably affixed to the exterior surface of slats 14. End cap 16 is fastened to one end and along the side of the structural layer 12 and the slats 14. The second end cap 18 is fastened to the opposite end and along the side of structural layer 12 and the slats 14. End cap 16 and 18 are nailed to their respective ends.

Figure 2:
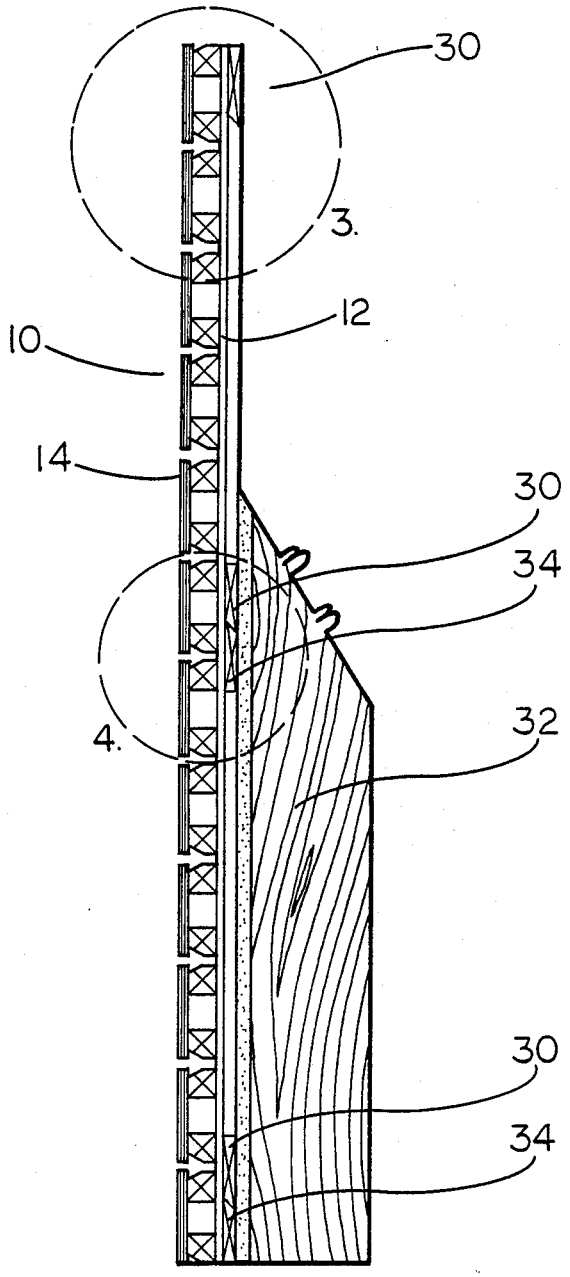
FIG. 2 is a cross-sectional view of the mounted display panel of the present invention.

FIG. 2 is a cross-sectional view of the display panel 10 of the present invention. As shown in FIG. 2, cleats 30 are fastened to the side of the structural layer 12 opposite the slats 14. FIG. 2 also shows the display panel 10 as removably attached to wall 32. Wall 32 can be any wall on the interior of an enclosure. Wall 32 has complementary cleats 34 rigidly affixed thereto. Complementary cleats 34 serve to connect display panel 10 to wall 32.

Figure 3:
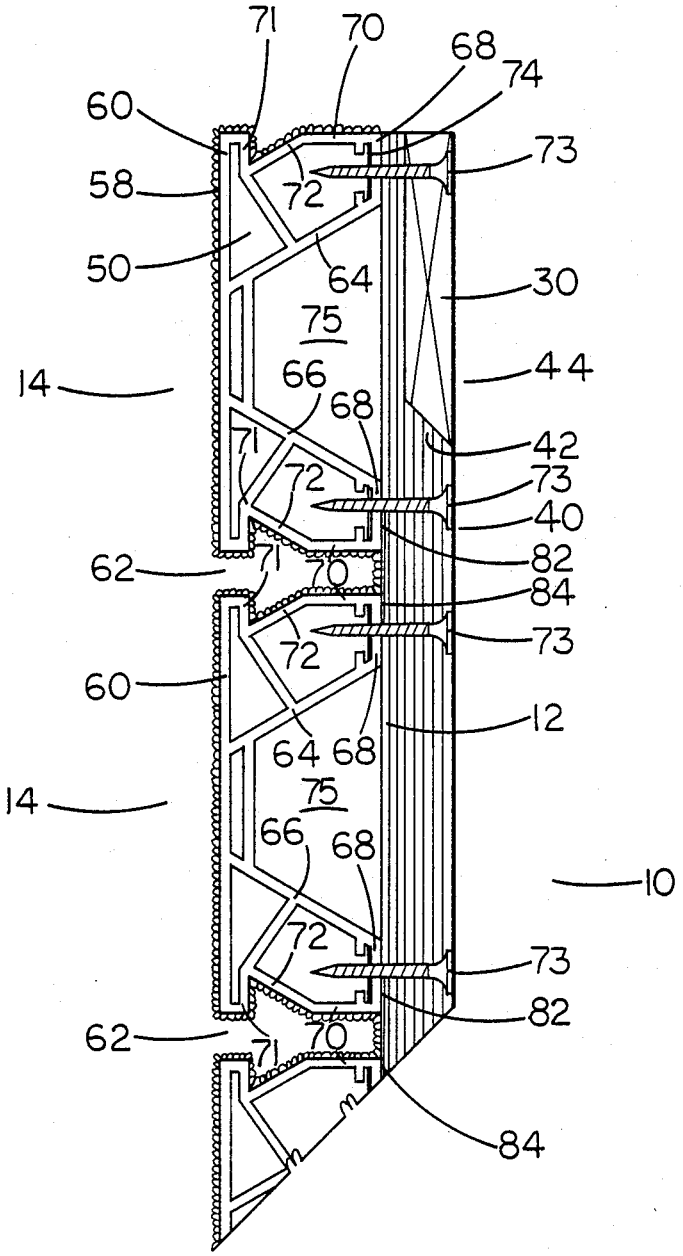
FIG. 3 is a close-up view of the circled area 3 of FIG. 2.

FIG. 3 is a close-up view of the circled area 3 of FIG. 2. FIG. 3 shows, in detail, cleat 30, structural layer 12, and slats 14. Structural layer 12 is a substantially planar layer of rigid material. As used in the preferred embodiment, structural layer 12 may be made of plywood or masonite.

Cleat 30 is a solid piece of wood that is rigidly fastened to surface 40 and structural layer 12. A cleat 30 may be attached by stapling and gluing or by any other means. Cleat 30 has a 45 degree angle cut 42 along its bottom edge. Angle cut 42 tapers from the outer edge 44 inwardly toward surface 40 of structural layer 12.

Slats 14 are depicted in greater detail in FIG. 3. In particular, slats 14 comprise a molded plastic member 50. A flexible material 58 is fixedly attached to the exterior surface of slats 14. The molded plastic member 50 has an outer planar face section 60. This face section 60 extends across the face of the flap to the horizontal slot 62. Throughout the display panel 10 of the present invention each of the face sections of plastic material 60 extend between and define the opening to the horizontal slots 62.

Angled structural support sections of plastic 64 and 66 angle outwardly from a central portion of the face section 60 toward the structural layer 12. At the structural layer 12, the angled sections 64 and 66 connect to a flat planar section 68 which abuts and is fact-to-face relationship with structural layer 12. The edge pieces 70 define the internal shape of horizontal slot 62. These edge sections of plastic material 70 extend between the planar face piece 60 and the planar abutment sections of plastic 68. Initially, section 70 extends horizontally from the face portion 60. A vertical portion 71 extends from this horizontal section so as to define an outwardly extending wall within horizontal slot 62. Angled portion 72 extends inwardly toward slot 62 so as to form a return to the horizontal portion 70 of slot 62. The angled wall portion of slot 62 as defined by this molded plastic slat 14 serves to receive the accessories of the slatwall of the present invention.

A fastener 73, such as a screw or bolt, fastens the molded plastic slat 14 at the area of abutment section 68 firmly to the structural layer 12. A steel banding 74 contained within the molded plastic slat 14 serves to firmly receive the threaded member 73 so as to strongly secure the molded plastic slat 14 to the structural layer 12.

The slot 62 has the angled portion 72 formed so as to communicate with the horizontal slot 62. The angled slot 72 has a height of between $\frac{3}{8}$ of an inch and $\frac{5}{8}$ of an inch and a width of greater than $\frac{3}{8}$ of an inch. The purpose of the angled slot 72 is to receive the lip portion of the slatwall accessories 22. The purpose of the angled portion is to allow the ease of accessory receiving and to allow the wall to be built in a curved fashion. The angled slot 72 includes a portion 71 that extends upwardly transverse to the horizontal slot 62. The face portion 60 defines the outer surface of the slot 62.

Cavity 75 is defined by the area between the angled structural members 64 and 66 and the inner surface of the structural layer 12. This cavity 75 is included to reduce the weight of the overall display panel 10. Cavity 75 may also be used to accept electrical conduits, telephone cable, or other appliances into the display panel 10. For example, it may be determined that it would be desirable to have a telephone attached to the exterior of display panel 10. Proper holes could be drilled through the flexible material 58, through the face piece 60, and the end cap or 18 so as to allow the telephone cable to extend through cavity 75. Cavity 75 extends along the length of the structural layer 12.

It should be noted for the purposes of description that the molded plastic members 14 should have the same shape. This allows for economy of molding, manufacture, and assembly.

Flexible material 58 fits around the exterior surfaces of slats 14. In particular, flexible material 58 is a single piece of material that extends over the top of the slat 14 defined by surfaces 70, 72, 71 and face piece 60. In other words, the flexible material 58 completely covers the molded plastic slat 14 except for the portion abutting the structural layer 12. Material 58 can be fitted over this exterior surface in several ways. The preferred embodiment is to spray glue or cement over these surfaces and then wrap the material over the surfaces. If contact cement is used, then it may be necessary to spray the back side of material 58 and the exterior surface of slat 14.

Material 58 may be used as decoration or as a functional material. Cloths, vinyls, laminants, and veneers may be the flexible material 58. Alternatively, the exterior surface of display board 10 can be made functional by fitting a velcro-receiving material over this exterior surface. Virtually any fabric could be applied and used as the velcroreceiving material. By using such a material, objects having VELCRO tape applied to the object's backside will be attachable to the outer, exterior surface of display board 10. In this manner, signs, pictures, or other displays can be readily attached to the exterior surface of the display board. FIG. 1 shows sign 24 fastened to the surface of display board 10 in such a manner.

An important feature of the present invention is the inclusion of hook-and-loop material 82 on the side of structural layer 12 opposite cleat 30. This VELCRO material is placed at the bottom of slot 62. In the preferred embodiment, the VELCRO-type material 82 has edges 84 and extending therefrom. Edge 84 is interposed between section 68 of slat 14 and the surface of structural layer 12. Similarly, edge 86 is fitted between the section 68 of the lower slat 14 50 and the surface of structural layer 12. This serves to maintain the hook-and-loop material 82 in proper position at the end of horizontal slot 62. The VELCRO type material 82 serves to fix the end of a shelf placed in horizontal slot 62 and to prevent the shelf from being easily removed from slot 62. Velcro material 82 will engage a corresponding material on the edge of a shelf placed in the horizontal slot 62. The inclusion of flexible material 58 throughout horizontal slot 62 further strengthens the fit of the shelf 20 within slot 62 and to facilitate the guidance of the shelf 20 into such a slot.

Alternatively, VELCRO-type material 82 may be a strip of VELCRO-type material without edge portions 84. In this manner, VELCRO-type material 82 can be fastened to the bottom of horizontal slot 62 by an adhesive applied to the back of the VELCRO-type material 82.

Figure 4:
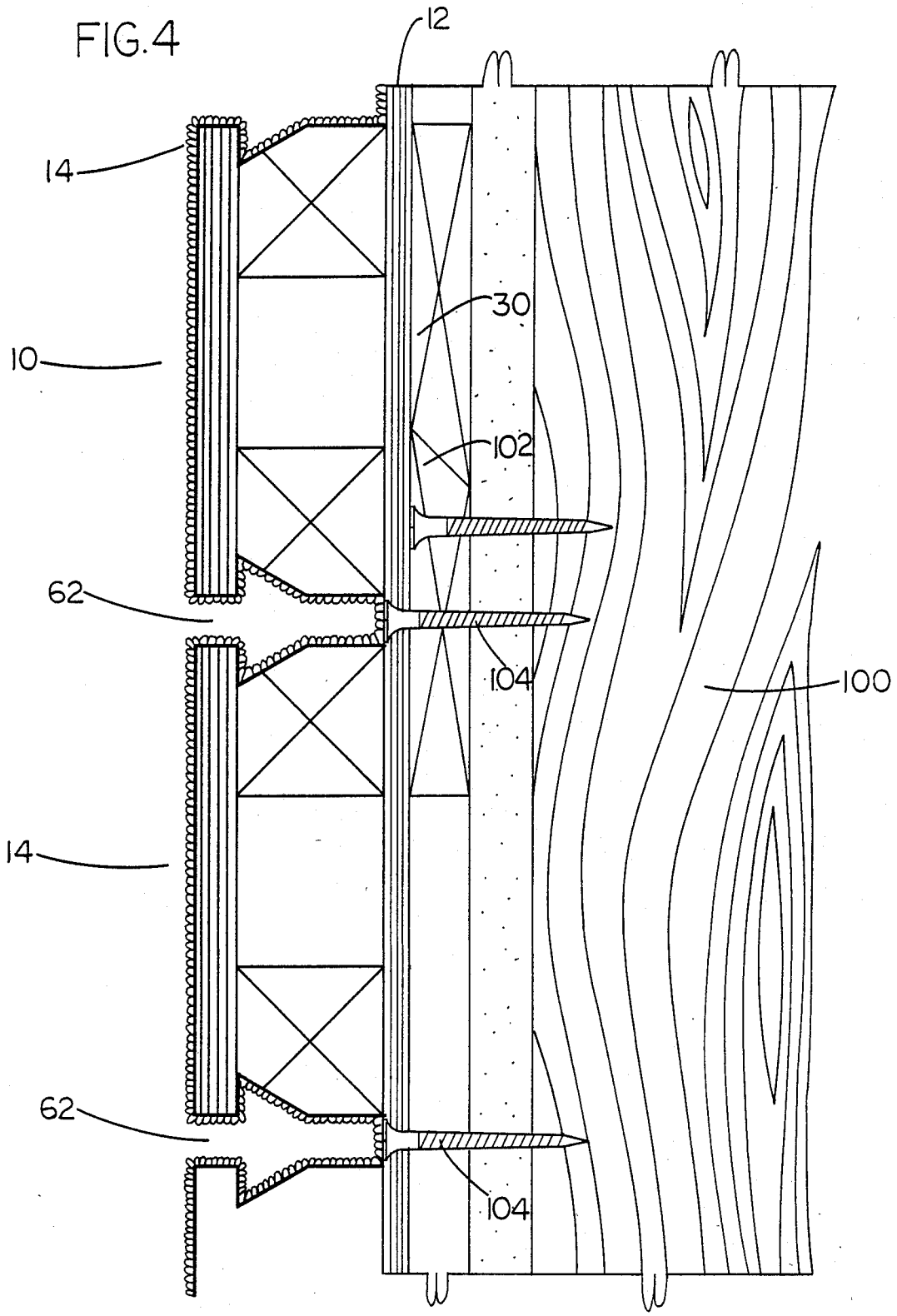
FIG. 4 is a close-up view of the circled area 4 of FIG. 2 showing, in addition, the use of screws to fix the display panel in position against a wall.

FIG. 4 shows a close-up view of the display board 10 as maintained in position adjacent a wall 100. FIG. 4 also shows the manner in which the cleat 30 engages a complementary cleat 102 affixed to wall 100. Complementary cleat 102 has an angle cut about the top lengthwise edge of cleat 102 which fits into the angle cut of cleat 30. In particular, cleat 102 has a 45 degree angle cut in which the taper is from the top of the cleat downwardly toward the wall 100. Display panel 10 is fastened to wall 100 by lowering cleat 30 onto the angle cut of complementary cleat 102. The angle of cut serves to properly position display panel 10 against wall 100, to retain display panel 10 in position, and to prevent display panel 10 from accidental dislodgement from wall 100. A proper vertical lifting force is required to remove cleat 30 from cleat 102.

Cleat 102 is fastened to wall 100. Cleat 102 maybe screwed, bolted, glued, or otherwise affixed to wall 100. The only significant requirement is that complementary cleat 102 be attached with sufficient strength to withstand the weight of display panel 10. If, after installation, it is found that the attachment force between the cleats and either display panel 10 or wall 100 is insufficient, then horizontal slots 62 allow screws 104 and 106 to be introduced to wall 100. Screw 104 can be inserted through slot 62, and threaded or self-tapped into wall 100. Because of the arrangement of slot 62, an appropriate tightening device, such as a screwdriver, can be inserted and utilized through slot 62. Screw 104 passe through cleat 30 and into wall 100. This serves to increase the fastening force between cleat 30 and structural layer 12. Screw 108 is inserted directly into wall 100. In this manner, the present invention would facilitate the semi-permanent mounting of the display panel 10 adjacent wall 100.

Alternatively, screws 104 and 106 can be replaced by alternative devices. These alternative devices could include nails or bolts.

Figure 5:
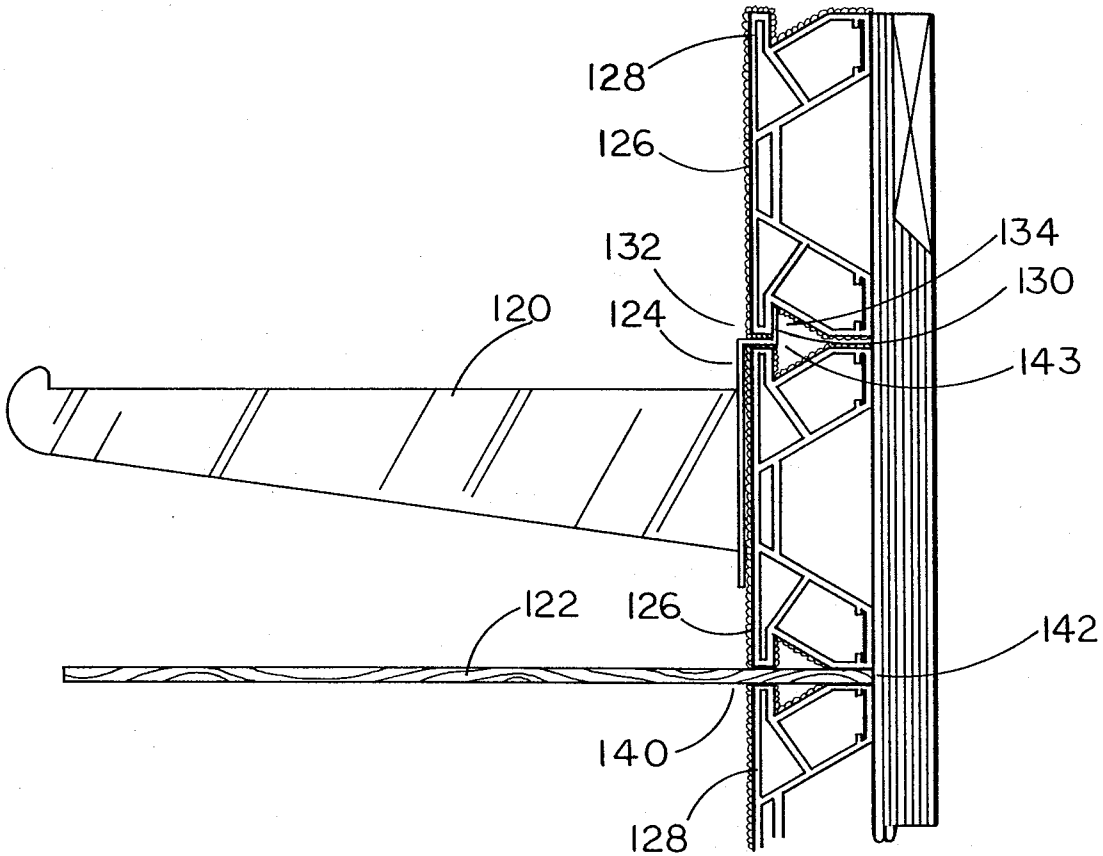
FIG. 5 is a cross-sectional view in side elevation of the display panel of the present invention showing its use in combination with slatwall accessories and shelving.

FIG. 5 shows how display panel 10 receives the slatwall accessory 120 and the shelf 122. The slatwall accessories come in a virtually infinite variety of apparatus. Slatwall accessory 120 is a hanger. Slatwall accessory 120 has a generally flat portion 124 which fits flush against the material 126. The juxtaposition of the flat portion 124 against material 126 and face section 128 provides most of the support for items hung on hanger 120. A lip 130 extends horizontally outwardly from flat portion 124 and abuts the bottom of slot 132, Lip 130 has a upwardly vertically extending portion which abuts the wall of angled slot 134. Thus, display panel 10 is adapted to properly receive those hardware, brackets, accessories, and appliances that would otherwise be suitable for present day slatwall.

Display panel 10 is also suitable for receiving shelf 122. Shelf 122 is a relatively flat board having a width of approximately ⅜ inch. Shelf 122 slides through slot 140 in a tight-fitting fashion. The end 142 of shelf 122 abuts the structural layer 12 and becomes attached by way of the VELCRO-type material, mentioned previously. The interaction of the material 126 with the fit of slot 140 and VELCRO-type material retains shelf 122 in its horizontal outwardly extending position.

FIG. 5 also shows an embodiment of the present invention in which the lower slot 143 is formed in the slats on the opposite side of horizontal slot 132 from the upper angled slot 134. The lower slot 143 can be used to accommodate a wider variety of slatwall devices. It can also make the display panel 10 reversible prior to mounting to cleats 30. The is modification also permits the panel to be mounted vertically. Certain types of slatwall accessories have a T-shaped bracket. This T-shaped bracket would attach to slots extending vertically (rather than horizontally) and support the slatwall accessory in that manner.

Figure 6:
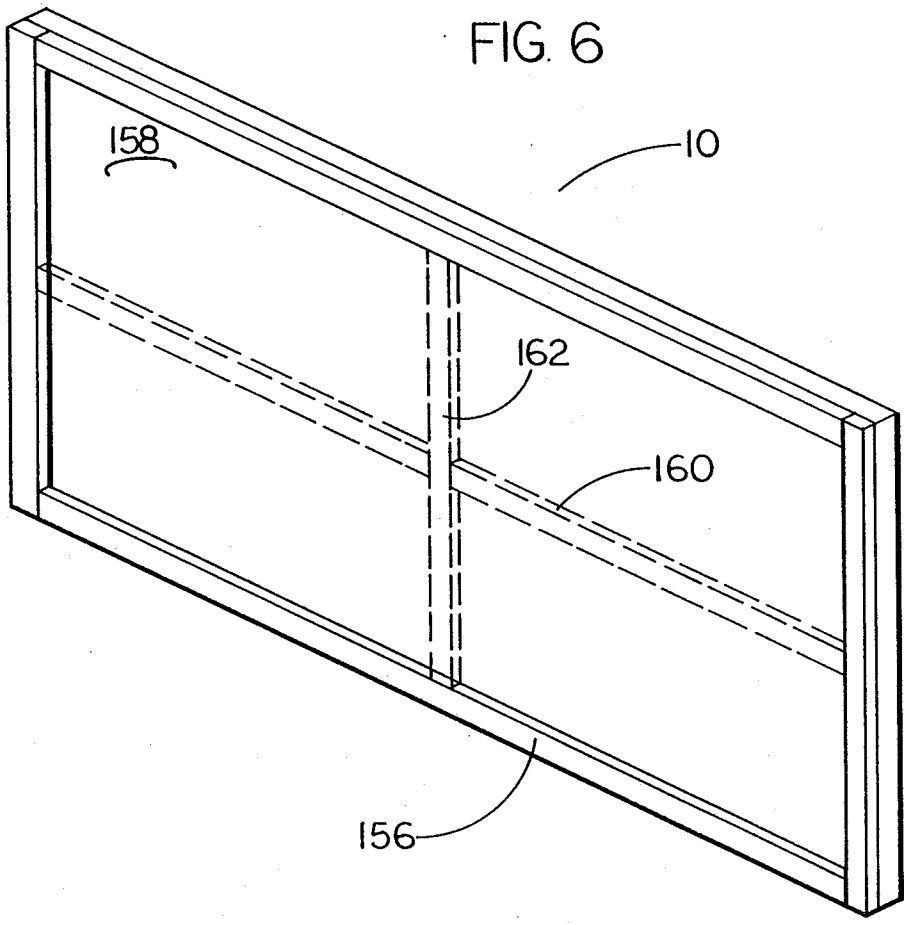
FIG. 6 is a rearward view, in perspective, of the display panel showing the location of the structural crossmembers.

FIG. 6 shows the rearward view of the display panel of the present invention. This view shows the rear of the panel without the cleats attached thereto. The rearward portion of display panel 10 has a frame section 156 extending along the outer boundary of the structural layer 158. A horizontal crossmember 160 extends lengthwise across the back of structural layer 158. A vertical crossmember 162 extends widthwise across the back of structural layer 158. The boundary frame 156, along with horizontal crossmember 160 and vertical crossmember 162, assumes much of the load-bearing forces applied to the display panel 10. These crossmembers and support structure are fastened by suitable means, such as gluing and stapling, to the back of the structural layer 158.

The display panel of the present invention offers a number of advantages not found in the prior art. First, since the entire panel is slidably removable from the wall on which it is positioned, the display panels may be easily interchanged depending upon the requirements and needs of the store using the panel. Secondly, the arrangement of slots between the slats allows the easy receipt of either slatwall accessories or shelving. The material covering the outer surface of the slats permits the attachment of signs, displays, pictures and other items. Additionally, the use of the hook-and-loop tape at the rearward portion of the horizontal slot allows shelves to be firmly fixed in position.

Through the use of the present invention, department stores would be able to change entire displays in a relatively short period of time. The stores would be able to adapt their facilities to the type of product being marketed. There is no need for costly permanent installation.

The present invention also is adaptable to a wide variety of various standing positions. For example, the display panel could be connected about its end caps to an adjacent display panel. The angled configuration between the separate display panels would allow the panels to rest on their lower edges without being attached to an internal wall of the store. The panels could be arranged in a triangular configuration, a square configuration, an L-shaped configuration, or a Z-shaped configuration. The present invention should not be restricted to merely being mounted on the internal wall of a store. With proper adjustments, the present invention also can be a self-standing unit.

Figure 7:
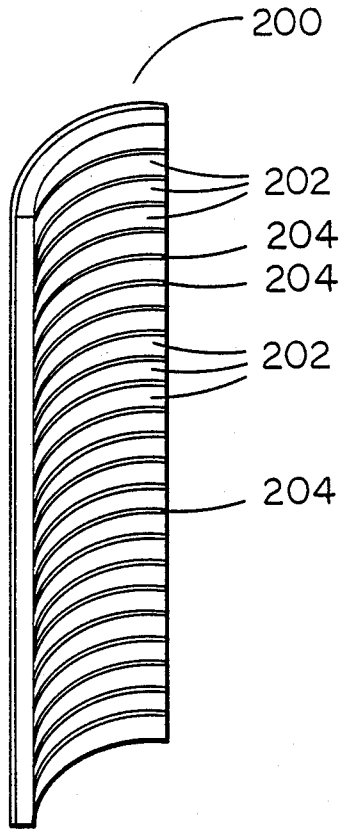
FIG. 7 shows an alternative configuration of a corner panel of the slatwall of the present invention.

FIG. 7 illustrates an alternative embodiment of the present invention which is suitable for use as a corner panel attached to the generally planar panel, described herein previously, or as a single separate component of the slatwall of the present invention. As can be seen, curved panel 200 has a quarter-circle configuration. A plurality of slats 202 form the outward, exterior of the display panel 200. Horizontal slots 204 extend inwardly between each of the slats 202. These slots 204 are suitable for receiving the slatwall accessories, described herein previously Because of the angled slot as described herein, it is a simple procedure for inserting the slatwall accessory into such slots. In prior embodiments of the present invention, it was found that a generally square "dado-38 type of slot would not work appropriately with a curved panel. Importantly, however, after experimentation, it was found that the curved panels could be built by the inclusion of an angled interior surface within the horizontal slots 204. It should also be realized that the configuration of FIG. 7 can be reversed with the same benefit and use.

The foregoing disclosure and description of the invention is illustrative and explanatory thereof, and various changes in the details of the illustrated apparatus may be made within the scope of the appended claims without departing from the true spirit of the invention. The present invention should be limited by the following claims and their legal equivalents.

We claim:

1. A display panel comprising:

a structural layer of rigid material;

a plurality of slat means fastened to said structural layer, said slat means having a first surface fastened to said structural layer, said slat means having a substantially planar second surface opposite said first surface, said slat means defining a horizontal slot between adjacent slat means, said slat means further comprising a receiving slot having a surface extending transverse to said horizontal slot and a surface angled relative to said horizontal slot;

fastening means attached to said structural layer, said fastening means for connecting said structural layer to an adjacent surface;

and a strip of hook-and-loop material fastened to said structural layer at the area of the said horizontal slot, said hook-and-loop material for fixing the horizontal movement of an object placed into said horizontal slot.

2. The display panel of claim 1, said slat means comprising:

a molded plastic member fastened to said structural layer, said plastic member having said receiving slot formed about an exterior surface of said plastic member and extending longitudinally along the length of said plastic member.

3. The display panel of claim 2, said slat means further comprising:

a face portion formed in the side of said slat means opposite said structural layer, said face portion having a planar shape extending between each of said horizontal slots.

4. The display panel of claim 2, said slat means further comprising:

a plurality of molded plastic members fastened to said structural layer, each of said molded plastic members having a length generally equal to the length of said structural layer and a width equal to a fraction of the width of said structural layer, the area between said molded plastic members forming said horizontal slot, said horizontal slot extending from the length of said structural layer.

5. The display panel of claim 4, said receiving slot formed so as to communicate with said horizontal slot adjacent the forward portion of said slot, said receiving slot having a height of between $\frac{3}{8}$ inch and $\frac{5}{8}$ inch, said receiving slot having a width of greater than $\frac{3}{8}$ inch.

6. The display panel of claim 2, said slat means further comprising:

a cavity formed within said molded plastic member, said cavity extending longitudinally along the length of said structural layer, said cavity for accommodating accessories external of said display panel.

7. The display panel of claim 1, said slat means being a molded plastic member comprising:

a face portion formed parallel to said structural layer;

an abutment section formed opposite to and parallel to said face portion, said abutment section for fastening in face-to-face relationship to said structural layer; and a structural support section extending between said face portion and said abutment section for maintaining said face portion in rigid position.

8. The display panel of claim 7, said structural support section comprising:

a first angled strut connecting and extending between said face portion and said abutment section;

a second angled strut connecting and extending between said face portion and said abutment section, said first and second angled struts extending at approximately 60 degrees relative to each other.

9. The display panel of claim 7, said slat means further comprising:

fastener means engaging said abutment section for rigidly affixing said slat means to said structural layer.

10. The display panel of claim 1, said display panel further comprising:

a flexible material fixedly fastened to the exterior surface of said slat means.

11. The display panel of claim 10, said flexible material comprising a hook-and-loop material for removably attaching an object having a hook-and-loop material attached thereto.

12. The display panel of claim 10, said material fixedly attached within said receiving slot of said slat means, said material fastened to the surface of one of said slat means adjacent another of said slat means.

13. The display panel of claim 1, said hook-and-loop material having an edge interposed between said slat means and said structural layer.

14. The display panel of claim 1, said fastening means comprising:

a cleat fixedly attached to the side of said structural layer opposite said slat means, said cleat having an angle cut along its lower edge, said angle cut for engaging a complementary angle cut in a support structure, said angle cut extending along the length of said cleat.

15. The display panel of claim 14, said cleat having a 45 degree angle cut, said cleat slidably engaging a complementary 45 degree angle cut in a structural member fastened to an interior wall of a building, said structural layer having a plurality of cleats distal from each other and extending longitudinally along said structural layer.

* * * * *